United States Patent [19]

Anthes

[11] Patent Number: 4,922,551

[45] Date of Patent: May 8, 1990

[54] OVERALLS FOR CRAWLING AND SLITHERING

[76] Inventor: George Anthes, 8830 Madison Ave., Fair Oaks, Calif. 95628

[21] Appl. No.: 264,454

[22] Filed: Oct. 31, 1988

[51] Int. Cl.[5] ..... A41D 1/06

[52] U.S. Cl. ..... 2/79; 2/69.5; 2/227

[58] Field of Search ..... 2/79, DIG. 6, 141 A, 2/227, 92, 46, 228, 2, 2.1 R, 2.1 A, 2.5, 69.5, 84

[56] References Cited

U.S. PATENT DOCUMENTS

| | | | |
|---|---|---|---|
| 997,669 | 7/1911 | Hall . | |
| 1,304,613 | 5/1919 | Smedley | 2/227 |
| 1,664,774 | 4/1928 | Edwards | 2/79 |
| 2,302,368 | 11/1942 | Evans | 2/94 |
| 2,493,370 | 1/1950 | Smith | 2/94 |
| 2,694,810 | 10/1954 | Williamson | 2/79 |
| 2,898,397 | 8/1959 | Patterson | 2/46 |
| 3,280,403 | 8/1966 | Nevitt | 2/79 |
| 3,805,295 | 10/1974 | Garcia | 2/79 |
| 4,356,569 | 11/1982 | Sullivan | 2/2.5 |
| 4,441,211 | 4/1984 | Donzis | 2/69 |
| 4,470,156 | 3/1984 | Duerbeck et al. | 2/227 |
| 4,667,344 | 4/1987 | Cooper III | 2/79 |
| 4,860,382 | 8/1989 | Markwell | 2/79 X |

FOREIGN PATENT DOCUMENTS

| | | | |
|---|---|---|---|
| 0202183 | 11/1986 | European Pat. Off. | 2/2.5 |
| 943282 | 4/1956 | Fed. Rep. of Germany | 2/2 |
| 2543046 | 4/1977 | Fed. Rep. of Germany | 2/79 |

OTHER PUBLICATIONS

"Velcro Product News" P.N.R. #1139 7-31-72, DIG. 6.

Velcro Product News, Velcro Corp., Jul. 19, 1976.

The North Face "Mountain Suit," Outside Magazine, Oct., 1988.

*Primary Examiner*—Werner H. Schroeder

*Assistant Examiner*—Jeanette E. Chapman

*Attorney, Agent, or Firm*—Joseph E. Gerber

[57] ABSTRACT

An overall body garment for crawling and slithering in cramped, dirty, damp conditions is disclosed, incorporating durable, slippery fabric with smooth, abrasion resistant pads protecting the garment and the wearer at the chest, belly, arms and legs. Constrictive means are provided at the neck, wrists and ankles to lock out dirt, moisture and pests. A long, offset zipper, an elastic waist, shoulder pleats, wide leg tubes and extra length in the extremities are also included to enhance comfort while working on one's knees or belly.

5 Claims, 3 Drawing Sheets

OVERALLS FOR CRAWLING AND SLITHERING

BACKGROUND OF THE INVENTION

1. Field Of The Invention

The present invention relates generally to overall garments, and more specifically to overalls for crawling and working on one's belly in cramped, dirty, damp, abrasive or otherwise uncomfortable conditions.

2. Description Of The Related Art

Most tradespersons and others who work in unclean environments would agree that some form of overgarment is necessary in order to make working conditions comfortable. To provide such comfort, overalls of various constructions have been employed. For example, U.S. Pat. No. 997,669 issued July 11, 1911 to Hall, and U.S. Pat. No. 2,694,810 issued Nov. 23, 1954 to Williamson disclose workman's overalls of familiar design. Such garments provide fair protection to the wearer's body and clothing from dirt and grime. However, such overalls are particularly likely to wear through when subjected to repeated abrasion, and when constructed of absorbent fabrics they offer little protection from moisture. Neither do such older designs effectively prevent ingress of such unpleasantries as moisture, dirt, insulation fibers and insects at the neck, wrists and ankles.

One approach to sealing a wearer's body against a foul environment is found in U.S. Pat. No. 3,280,403 issued Oct. 25, 1966 to Nevitt. Therein, a surgical coverall is disclosed offering moisture protection and tight seals at the neck, sleeves and leg ends. However, such a garment is very unlikely to withstand continual abrasion without damage, particularly if used while working on one's hands and knees, or while slithering in a prone position on rough surfaces.

Overall garments designed for a few other purposes have also shown some measure of body sealing capability. For example, a wind resistant garment with neck, wrist and ankle closures designed for skydivers and motorcyclists is disclosed in U.S. Pat. No. 3,805,295 issued Apr. 23, 1974 to Garcia. Garcia's garment also incorporates additional fabric layers at the elbows and knees. But, these additional layers are not directed to, nor do they appear adequate for, achieving superior abrasion and friction resistance. Likewise, the foul weather garment of U.S. Pat. No. 4,667,344 issued May 26, 1987 to Cooper, III appears to offer body sealing capability, but fails to provide the garment and the wearer protection from abrasion.

To achieve abrasion resistance at common wear points additional layers of durable fabric have been employed in trousers as shown in U.S. Pat. No. 4,470,156 issued Sept. 11, 1984 to Duerbeck and Duerbeck. But, such constructions fail to offer moisture resistance, tend to bind frictionally upon adjacent surfaces, and continue to leave the knees and legs of the wearer vulnerable to pointed or sharp objects such as splinters, and the like.

SUMMARY OF THE INVENTION

The overall garment of the present invention is adapted to overcome the foregoing shortcomings. It further provides advantageous features particularly important to one working in cramped, dusty, dirty conditions on the belly or hands and knees, and where the garment is continually subjected to abrasion and puncture by rough surfaces at the knees, forearms, elbows, chest and belly. These are conditions often encountered by workers in the building trades where it sometimes becomes necessary to squeeze into crawl spaces, around the interiors of foundations, between beams in attics, and the like.

The garment claimed herein employs an overall body covering of durable, tightly woven, slippery, snag resistant fabric with smooth, abrasion resistant pads protecting the garment and the wearer at the chest, belly, arms and legs. Constrictive means are provided at the neck, wrists and ankles to lock out dirt, moisture and pests. Additional features such as a long offset zipper, an elastic-backed waist, pleats, wide leg tubes and extra length in the extremities combine with the foregoing to provide a superior overall garment for working on one's knees or belly in cleanliness and comfort. The garment may also be moisture resistant to accommodate damp environments.

Thus, it is an object of the present invention to provide a durable, snag and abrasion resistant overall garment especially suited to keeping the wearer clean and comfortable while crawling or slithering through rough, dusty, dirty, pest-inhabited, and perhaps damp environments.

It is a further object of the present invention to provide a protective overall garment with sufficient flexibility to allow comfort in crawling and slithering as well as in walking and upright movement by the wearer.

A further object of the present invention is to provide a protective overall garment easy for the wearer to don and doff.

Yet another object of this invention is to provide such an overall garment with closure means placed so as to avoid fouling with dirt, and the like.

Still further objects of the inventive overall garment disclosed herein will be apparent from the drawings and following description thereof.

DESCRIPTION OF THE PREFERRED EMBODIMENT

Figure 1:
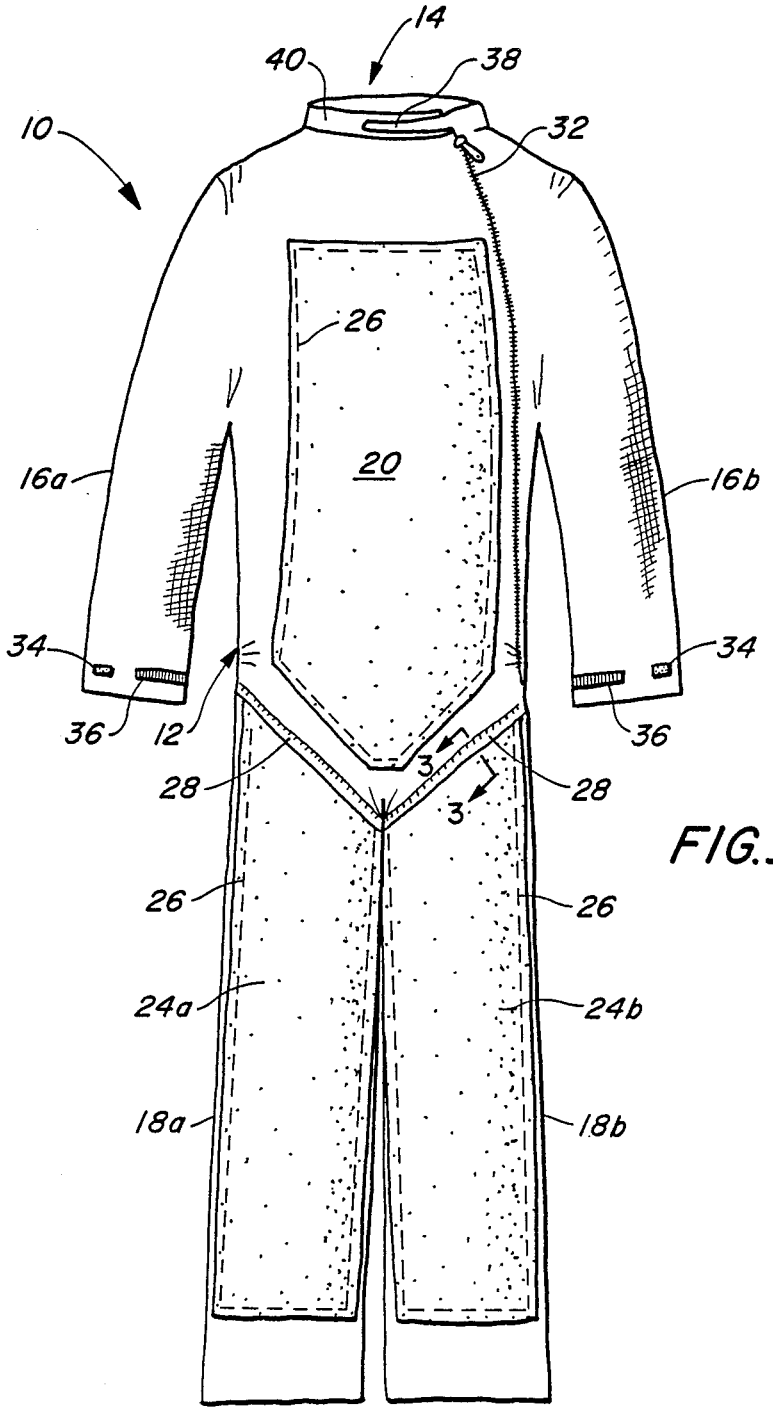
FIG. 1 is a front elevational view of the preferred embodiment of the inventive overalls for crawling, slithering and working in a prone position.
Figure 2:
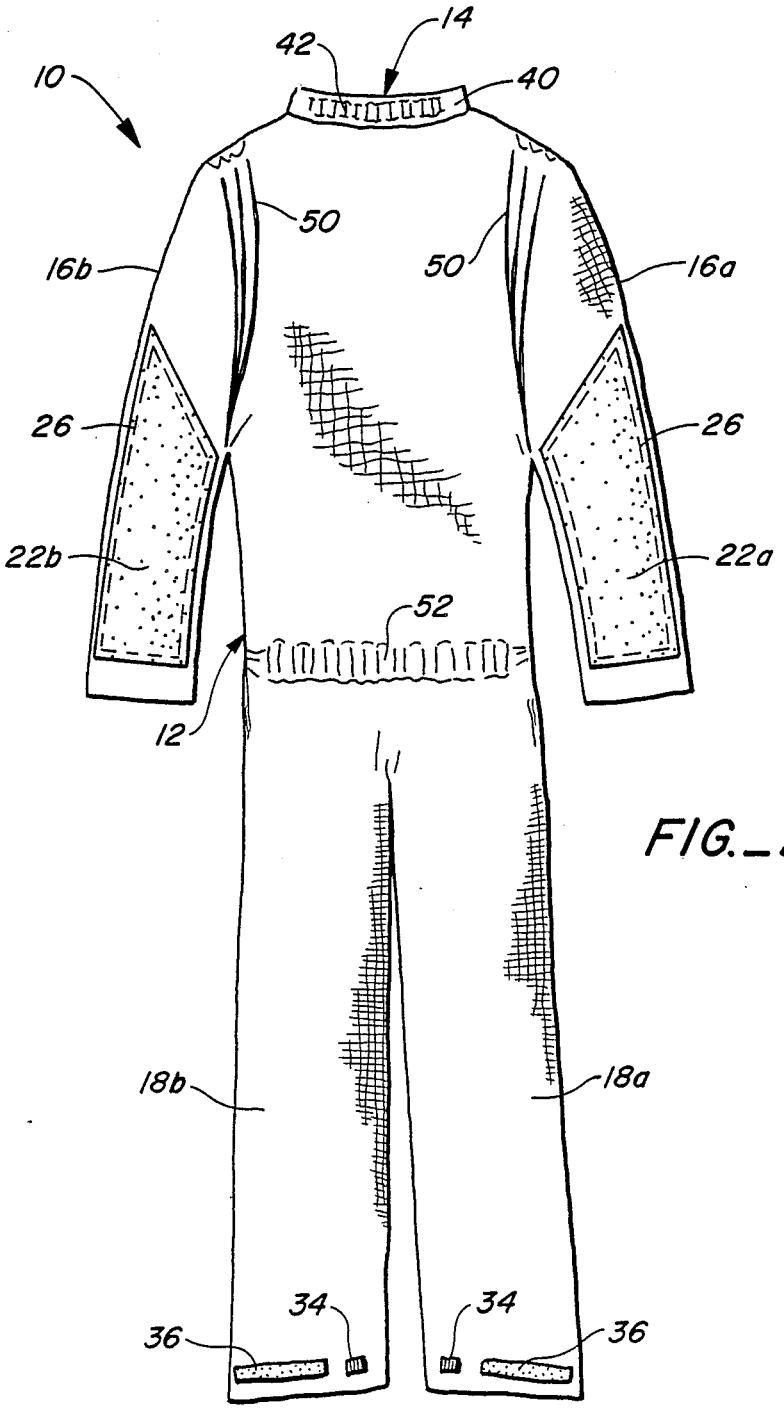
FIG. 2 is a rear elevational view of the preferred embodiment of the inventive overalls.

Referring now specifically to the drawings, FIGS. 1 and 2 show the inventive overall garment generally indicated by reference numeral 10. Said overall garment 10 is constructed of a body covering of durable, tightly woven, snag resistant fabric. Said fabric is preferably of a synthetic nature, nylon being one fabric that has been used with success. Other fabrics may work as well as long as they are relatively napless; those with a smooth, slippery surface being preferred. The weight and construction of the fabric employed in the body covering may be specifically chosen for the level of protection required. For example, light duty use may permit utilization of such fabrics as "rip-stop" nylon or taffeta, while heavier use may require "pack cloth" or duck. The body covering fabric may also be coated with urethane or the like to give the fabric a moisture resistant quality.

The overall garment 10 includes a torso portion 12 with a neck opening 14. Torso portion 12 has sleeves attached thereto in the form of right and left arm tubes, 16*a* and 16*b* respectively, extending outwardly from the upper sides or shoulder area thereof. Right and left leg tubes, 18*a* and 18*b* respectively, extend downwardly from the hip area at the lower extreme of torso portion 12. Said arm tubes 16*a* and 16*b*, and said leg tubes 18*a* and 18*b*, may extend from or be attached to said torso portion 12 by any means conventional in the art.

Arm tubes 16*a* and 16*b*, and leg tubes 18*a* and 18*b*, have proximal ends attached to, and located adjacent to, the torso portion 12 of garment 10. Each also has an open distal end located away from, and unattached to, torso 12.

To portions of the overall garment 10 particularly susceptible to abrasive wear while crawling or slithering on the belly, additional protective means are applied. The preferred embodiment of said garment 10 employs a torso pad 20, right and left arm pads, 22*a* and 22*b* respectively, and right and left leg pads, 24*a* and 24*b* respectively. Said torso pad 20 is anteriorly disposed upon garment 10, and covers substantially the entire chest and belly area of the torso portion 12 thereof. This is one of the areas very likely to snag while belly crawling and to wear out prematurely from such continued use.

As seen in FIG. 2, arm pads 22*a* and 22*b* are disposed upon the posterior faces of arm tubes 16*a* and 16*b*, respectively, thereby covering and protecting substantially the entire weight-bearing portions of a crawling or slithering wearer's forearms and elbows. As shown in FIG. 1, leg pads 24*a* and 24*b* are disposed upon, and cover substantially, the entire anterior portion of leg tubes 18*a* and 18*b*, respectively. Thus, the areas of garment 10 most likely to snag and wear out from belly crawling and slithering, as well crawling on the hands and knees, are protected.

Said pads 20, 22*a*, 22*b*, 24*a* and 24*b* are preferably of a smooth-surfaced sheeting material able to be sewed or otherwise securely adhered to the fabric of overall garment 10. These pads should be sufficiently abrasion resistant to increase materially the wear-life of the garment at the points to which they are applied. It is also desirable that they be sufficiently thick and smooth to allow the wearer to slide easily over rough surfaces. Further, adequate flexibility to allow comfortable movement by the wearer while walking, squatting, crawling or slithering is preferred. And, for appearance purposes, the best pad material is one that may be wiped clean after being soiled. Smooth-surfaced, fabric-backed vinyl sheeting of 1/32" to 1/16" in thickness has been used successfully, that sold under the trademark "Naugahyde" having been found to be one material possessing these desired qualities. But, other sheeting material such as leather may also perform well. If a material not inherently impervious to water such as leather is employed, a coating may be applied thereto for use of the garment in damp environments.

When water impervious pads such as vinyl or coated leather are deployed on the embodiment of garment 10 constructed of non-coated fabric, moisture is prevented from soaking through the garment from damp earth, and the like, at those points bearing the bulk of the crawling or slithering wearer's weight, namely the knees, belly, chest and forearms. And, when such pads are deployed upon a garment 10 of coated fabric, an additional measure of protection from moisture is enjoyed.

Application of pads 20, 22*a*, 22*b*, 24*a* and 24*b* to the fabric of overall garment 10 yield not only a longer wearing garment, but also a garment that protects the wearer's body at the points of most pressure from potentially painful contact with uncomfortable surfaces.

Heavy duty stitching 26 around the periphery of each pad provides one sure method of secure attachment of said pads to the fabric of garment 10. Such stitching may be accomplished with conventional thread of natural or synthetic composition, having multiple strands or fibers. Or, the stitching may be done with synthetic monofilament line for additional protection against abrasive destruction of the stitches. Adhesives may also be used in conjunction with, or as an alternative to, stitching.

It is further desirable to add additional reinforcement to the tops of leg pads 24*a* and 24*b*, as they are most likely to separate from the base fabric of garment 10 during forward slithering on abrasive surfaces. The preferred reinforcement, as shown in FIG. 1, and as shown in section in FIG. 3, first entails rolling a layer of the base fabric of leg tubes 18*a* and 18*b* over the upper leading edge of their respective leg pads 24*a* and 24*b*. Stitches 26 are then driven through the fabric lying over the pad, down through the pad itself, and through the fabric under the pad to bind all three layers together. The upper layer of fabric is then folded back over itself to further protect the stitches 26 from abrasion.

Figure 3:
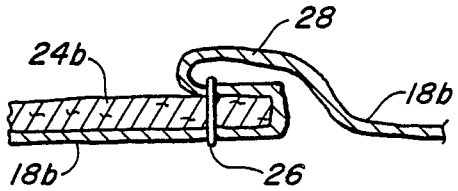
FIG. 3 is a sectional view showing the fabric of a leg tube rolled and stitched over the top of a leg pad.

Refinements in the shape of pads 20, 22*a*, 22*b*, 24*a* and 24*b* also lend improved performance to this inventive overall garment 10. For example, torso pad 20 covering substantially the entire anterior portion, the chest and belly area, of the torso 12 of garment 10 is a single continuous piece of material providing a smooth, low friction gliding surface for slithering on one's belly. And, as shown in FIGS. 1 and 3, the lower corners of torso pad 20 are cut on angles mating with cooperating angles on the proximal top edges of leg pads 24*a* and 24*b*, said cooperating angles being directed upward and away from the crotch between leg tubes 18*a* and 18*b*, thereby allowing freedom of movement while walking, crawling, stooping or squatting. It will also be realized that said angled tops on leg pads 24*a* and 24*b* are effective to reduce binding of the pads on passing objects, by deflecting same, while one is slithering forward on one's belly.

As shown in FIG. 2 arm pads 22*a* and 22*b* are also angled at their proximal ends. This refinement reduces uncomfortable buckling when one's elbows are bent.

To allow the wearer ease in putting on and taking off the overall garment 10, a laterally displaced slit 30 extending downward from the neck opening 14, substantially to the waist area of the torso portion 12 of the garment 10, is provided. Closure means in slit 30, preferably in the form of a slide fastener such as zipper 32, provides a relatively secure seal against ingress of any unpleasantries of the surrounding environment. Further, said zipper 32 lends strength and integrity to the entire garment 10. This becomes very important as the garment 10 is subjected to stresses caused by its catching on passing objects, and the crawling and slithering movements of the wearer.

The offset placement of slit 30 and zipper 32 as shown, has the desirable effect of greatly reducing the likelihood of fouling zipper 32 with dirt and other debris. In the absence of such offset placement, as in conventional midfrontal location of a zipper, the weight of the wearer's body upon the zipper in such environments for which garment 10 is designed would promote fouling with dirt, mud and the like. Thus, such undesirable effects are avoided by zipper 32's offset placement.

This inventive overall garment 10 is also designed to seal the wearer's body against ingress of foreign material and vermin at the neck, wrists and ankles. To this end, constrictive closure means are provided at all points where the wearer's body projects outside garment 10. The distal ends of arm tubes 16*a* and 16*b*, and leg tubes 18*a* and 18*b*, employ similar constrictive closure means, those means preferably being mechanically interlocking fabric patches 34 and 36, such as are sold under the trademark "Velcro." Said patches 34 and 36 are adhesively or otherwise bound to the underlying fabric of garment 10. Although the foregoing is the preferred closure means, other suitable releasable fastening means may also be successfully employed.

Figure 4:
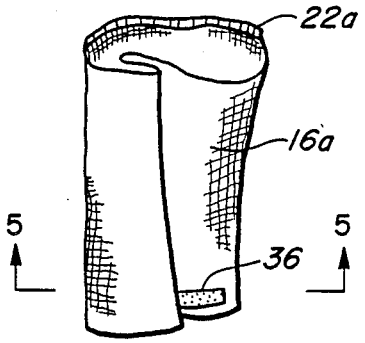
FIG. 4 is a front view of a constricted arm tube end.

Considering one type of use for which the garment 10 is designed, crawling and slithering through tight spaces, it is particularly important that no loose fabric be available at the wrists and ankles to catch on passing objects. Not only would this unnecessarily hamper movement, it would also destroy the seal at such points. Therefore, the preferred constrictive closure means comprises mechanically interlocking fabric patches arranged so as to provide a smooth tight seal around the wrist or ankle. This is best achieved, as is shown in the representative right wrist closure of FIGS. 4 and 5, by providing small and large mating patches, 34 and 36 respectively, on the surface of garment 10's fabric, near the open distal end of arm tube 16*a*. When said small patch 34, and the fabric to which it is attached, are lifted, wrapped about a wrist and bound to the point on the larger patch 36 providing the proper tight seal, the fabric of the arm tube 16*a* end will necessarily lie flat without loose, protruding flaps. The special arrangement of small patch 34 in combination with larger patch 36 avoids buckling in the area of the seal often experienced when such closures are designed so as to require that a section of the relatively stiff mechanically interlocking fabric, and the underlying fabric to which it is bound, be folded to make a seal. In contrast, use of the preferred arrangement provides a smooth, tight seal about a wide range of wrist or ankle sizes, thereby utilizing a single tight fold only in the base fabric, and avoiding the bulge likely to occur if a fold is made in a an oversized piece of stiff patch material.

Figure 5:
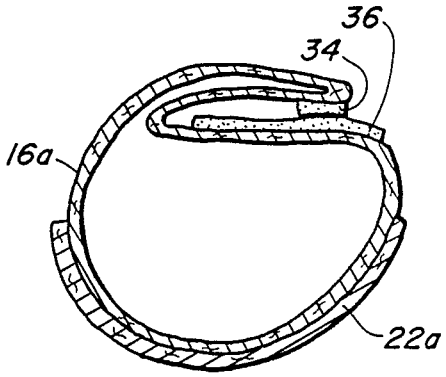
FIG. 5 is a sectional view taken along lines 5—5 of FIG. 4.

Further, the smoothest seal is realized, and buckling of distal ends of protective pads 22*a*, 22*b*, 24*a* and 24*b* is minimized, when said preferred closure means fastens radially opposite the pad on any given arm or leg tube as best shown for right arm tube 16*a* in FIG. 5.

Figure 6:
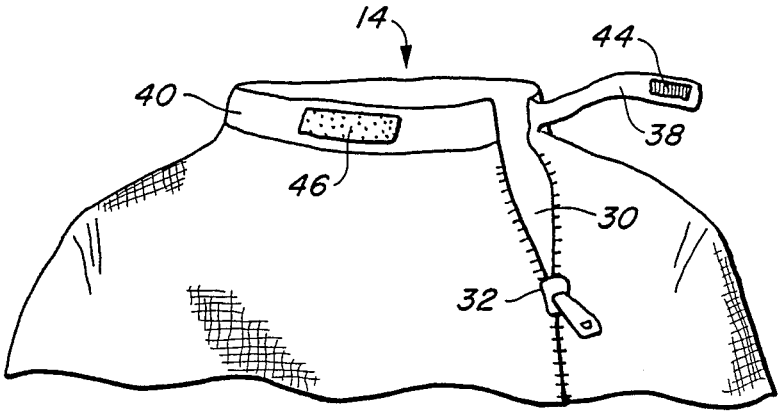
FIG. 6 is a front view of the neck portion of the inventive overalls showing the preferred neck closure in an open position.

Neck opening 14 also requires constrictive means to lend integrity to the body sealing function of the entire garment 10. For this purpose a neck strap 38 is bound to and extends from one side of collar 40, across the top of slit 30, to fasten removeably on the other side of collar 40, thereby forming a good seal around the neck; see FIGS. 1 and 6. Improved comfort and sealing is achieved by disposing an elastic strip inside collar 40 by any conventional means, many of which are known in the art. This results in a gathered portion 42 in the back of collar 40.

Fastening means for securing strap 38 across the top of slit 30 are also provided, said means preferably being a pair of mating mechanically interlocking fabric strips. A first strip 44 is affixed to the inside face of the free end of neck strap 38, and a second strip 46 is affixed to the opposite side of collar 40.

It will be realized by those skilled in the art that various well-known alternative constrictive means may be used at neck opening 14 with satisfactory results.

Ease of movement in the overall garment 10, so necessary for use in environments for which it is designed, is enhanced by providing extra length in the extremities. In contrast, if arm and leg tubes, 16*a* and 16*b*, and 18*a* and 18*b* respectively, were cut to that length normally required in the wearer's conventional clothing, garment 10 would be uncomfortably restrictive of movement when closure means at the wearer's wrists and ankles were fastened. But, by cutting arm tubes 16*a* and 16*b* approximately 1.5 inches longer than the wearer's size usually requires, and by cutting leg tubes 18*a* and 18*b* approximately 2.5 inches longer than the wearer's size usually requires, free flexion of the waist and extremities is permitted despite closure means being bound at the wrists and ankles.

To promote further ease in putting on and taking off garment 10, leg tubes 18*a* and 18*b* are preferably constructed with a bore sufficient to pass the work boot of a wearer therethrough. Thus, ease of use in common working conditions is enhanced by making removal of such footwear unnecessary in order to don garment 10.

Ease of upper body movement in garment 10 is further enhanced by pleats, one example being shown in FIG. 2 where pleats 50 are comprised of extra folds of fabric at the upper back of torso 12, near arm tubes 16*a* and 16*b*.

Figure 7:
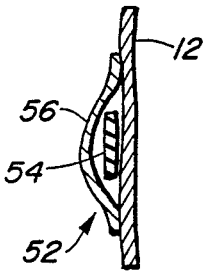
FIG. 7 is a sectional view of an elastic waistband in a fabric channel.

As shown in FIG. 2, garment 10 is held snug to the waist of the wearer by incorporation of a waistband 52 into the lower region of the posterior of its torso portion 12. As best shown in cross-section in FIG. 7, said waistband 52 is preferably an expansible and contractible fabric band 54 such as elastic affixed to the ends of, and slideably disposed in, a channel 56 of the same fabric as that of garment 10.

In use, the wearer simply steps into the leg tubes 18*a* and 18*b* of garment 10 through the long entry slit 30, thereafter sliding both arms into sleeves 16*a* and 16*b*. The garment is then pulled up around the shoulders and zipper 32 is drawn up from the waist to the neck, closing slit 30. Distal arm and leg tube ends are drawn tight around their respective extremities as described above, and finally, neck strap 38 is drawn snugly around the wearer's neck to seal collar 40. Thus, garment 10 covers the wearer's everyday cloths completely.

The wearer is then comfortably protected from unpleasantries as are often encountered by those working in the building trades, and the like, such as dirt, dust, insulation fibers, insects and other vermin. Further, the slippery character of the fabric used in garment 10 significantly reduces the frictional binding normally encountered when squeezing through tight spaces. Additionally, if the alternative moisture resistant form of the inventive overalls is employed, damp or somewhat muddy environments may be encountered in similar comfort.

Once a task in such a hostile environment is complete, the pads and fabric of the garment may simply be wiped off to restore some measure of a neat appearance. The garment may subsequently be removed, whereunder the wearer's everyday cloths have been preserved in a clean and dry condition. Following this, the garment may also be machine washed.

The foregoing detailed disclosure of the inventive overall garment 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for these inventive overalls may be later be realized. Accordingly, the scope of the invention should be determined with reference to the appended claims, and not by the examples which have herein been given.

What is claimed is:

1. A worker's overall garment to cover the entire body from neck to ankles to wrists, comprising, in combination:

a. an overall body covering of durable, slippery fabric including a torso portion having a constrictable neck opening, a pair of generally cylindrical arm tubes extending outwardly from the upper sides of said torso poriton, each having constrictive means at its distal end, and a pair of generally cylindrical leg tubes depending with a crotch therebetween from the lower extreme of said torso portion, each having constrictive means at its distal end;

b. a torso pad of smooth, flexible, abrasion-resistant material affixed to, and covering substantially, the entire anterior face of said torso portion;

c. a pair of arm pads, each having proximal and distal ends and comprising a sheet of smooth, flexible, abrasion-resistant material affixed to, and covering at least the forearm portion of, the posterior face of one of said arm tubes;

d. a pair of leg pads, each having proximal and distal ends and comprising a sheet of smooth, flexible, abrasion-resistant material affixed to, and covering substantially, the entire anterior face of one of said leg tubes, the proximal end of each said pad being cut diagonally upward and away from said crotch, each said proximal end, further, being covered with a fabric layer; and, e. a closeable slit forming an entry opening extending from the necks opening substantially to the waistline of the torso portion, and running adjacent but peripheral to the perimeter of said torso pad, including means for closing said slit.

2. The garment of claim 11 wherein the distal end of each of a plurality of said tubes includes a first mechanically-interlocking fabric patch at least twice as long as a second patch and sufficiently spaced therefrom to allow substantial adjustability in said distal end for fixedly wrapping same about the limb of a wearer.

3. A worker's overall garment to cover the entire body from neck to ankles to wrists, comprising, in combination:

a. an overall body covering of durable, slippery fabric including:

i. a torso portion having a constrictable neck opening;

ii. a pair of generally cylindrical arm tubes extending outwardly from the upper sides of said torso portion, each having constrictive means at its distal end comprising a first mechanically-interlocking fabric patch at least twice as long as a second patch and sufficiently spaced therefrom to allow substantial adjustability in said arm tube end; and, iii. a pair of generally cylindrical leg tubes depending with a crotch therebetween from the lower extreme of said torso portion, each having constrictive means at its distal end comprising a first mechanically-interlocking fabric patch at least twice as long as a second patch and sufficiently spaced therefrom to allow substantial adjustability in said leg tube end;

b. a torso pad of smooth, flexible, abrasion-resistant material affixed to, and covering substantially, the entire anterior face of said torso portion;

c. a pair of arm pads, each having proximal and distal ends and comprising a sheet of smooth, flexible, abrasion-resistant material affixed to, and covering at least the forearm portion of, the posterior face of one of said arm tubes;

d. a pair of leg pads, each having proximal and distal ends and comprising a sheet of smooth, flexible, abrasion-resistant material affixed to, and covering substantially, the entire anterior face of one of said leg tubes; and, e. a closeable slit forming an entry opening extending from the neck opening substantially to the waistline of the torso portion, and running adjacent but peripheral to the perimeter of said torso pad, including means for closing said slit.

4. The garment of claim 3 wherein the proximal ends of said leg pads are covered with a fabric layer.

5. The garment of claim 4 wherein the proximal ends of said leg pads are cut diagonally upward and away from said crotch.

* * * * *